US008081133B2

(12) United States Patent
Shen

(10) Patent No.: US 8,081,133 B2
(45) Date of Patent: Dec. 20, 2011

(54) SATELLITE ANTENNA WITH HOLDER ASSEMBLY FOR HOLDING LNBF

(75) Inventor: Wen-Chao Shen, Bade (TW)

(73) Assignee: Azure Shine International Inc., Bade, Taoyuan (TW)

( * ) Notice: Subject to any disclaimer, the term of this patent is extended or adjusted under 35 U.S.C. 154(b) by 398 days.

(21) Appl. No.: 12/453,731

(22) Filed: May 20, 2009

(65) Prior Publication Data

US 2010/0097288 A1 Apr. 22, 2010

(30) Foreign Application Priority Data

Oct. 17, 2008 (TW) ..... 97218536 U

(51) Int. Cl.
*H01Q 19/12* (2006.01)

(52) U.S. Cl. ..... 343/840; 343/878

(58) Field of Classification Search ..... 343/878, 343/888, 889, 890, 892, 840, 772, 775
See application file for complete search history.

(56) References Cited

U.S. PATENT DOCUMENTS

| | | | | |
|---|---|---|---|---|
| 6,211,842 | B1 * | 4/2001 | Cousin et al. | 343/840 |
| 6,445,361 | B2 * | 9/2002 | Liu et al. | 343/882 |
| 7,385,564 | B2 * | 6/2008 | Zihlman | 343/878 |
| 2010/0013727 | A1 * | 1/2010 | Pifer et al. | 343/779 |

* cited by examiner

*Primary Examiner* — Dieu H Duong
(74) *Attorney, Agent, or Firm* — Stites & Harbison PLLC; Juan Carlos A. Marquez, Esq.

(57) ABSTRACT

A satellite antenna includes an antenna dish, a connecting arm, a pole, at least one clamp and a cover bracket. The antenna dish may include a front surface and a rear surface. The connecting arm has a first end and a second end, wherein the first end is coupled with the rear surface of the antenna dish. The pole may extend transversely with respect to the connecting arm and may include a channel extending from one end to the other end of the pole. The at least one clamp may each include a base with an opening that allows the pole to pass through. The cover bracket may include a front cover to seal the second end of the connecting arm, and a first cover integral with the front cover that includes a first side and a second side. The first cover may support the pole over the connecting arm on the first side and engage with the connecting arm with the second side.

20 Claims, 8 Drawing Sheets

SATELLITE ANTENNA WITH HOLDER ASSEMBLY FOR HOLDING LNBF

CROSS REFERENCE TO RELATED APPLICATION

This application claims the benefit of an R.O.C. Application No. 097218536 filed Oct. 17, 2008.

BACKGROUND OF THE INVENTION

The present invention relates generally to satellite communications and, more particularly, to a satellite antenna with a holder assembly for holding at least one "low-noise block converter (LNB) with feed horn" (collectively LNBF).

Traditional radio communications may generally be susceptible to environmental factors such as terrestrial topology, weather conditions and spatial electromagnetic fields. Consequently, signal quality may be degraded due to reflection, refraction and diffusion of radio waves transmitting in the environment. The environmental factors have been alleviated with the advent of satellite communication technologies. In satellite communications, a satellite antenna which serves as an earth station is used to receive satellite signals such as telephone, television and radio signals. The satellite antenna may comprise a satellite antenna dish, a feed horn, a low-noise amplifier (LNA) with a downconverter (collectively LNB) and a satellite receiver for receiving audio and video signal from a satellite in geosynchronous orbit around the earth.

The satellite antenna dish can reflect and transmit satellite signals and may generally take the form of a parabolic configuration to facilitate the collection of signals dispersed at the dish surface at a focused point in front of the antenna dish where the feed horn is located. The feed horn may work in conjunction with the LNB so as to process signals reflected by the antenna dish at the focused point. An LNB with a feed horn may often be termed an "LNBF".

FIG. 1 is a perspective view of a conventional satellite antenna 10. Referring to FIG. 1, the satellite antenna 10 may include an antenna dish 11, a mast 12 to support the antenna dish 11, and a connecting arm 13 with one end secured to a rear surface of the antenna dish 11 and the other end holding an LNBF 14 in front of the antenna dish 11. Since only one LNBF is equipped, it may be relatively easy to adjust the elevation and azimuth angles of the LNBF 14 for the orientation of the satellite antenna 10. With the rapid development in the satellite industry, however, there is increasing interest in satellite antennas with multiple LNBFs. As compared to the case of a single LNBF, it may become difficult or complicated to adjust a satellite antenna with multiple LNBFs in orientation in a precise fashion. It may therefore be desirable to have an apparatus that allows flexible positioning and adjustment of multiple LNBFs of a satellite antenna.

BRIEF SUMMARY OF THE INVENTION

Examples of the present invention may provide a satellite antenna that comprises an antenna dish, a connecting arm, a pole, at least one clamp and a cover bracket. The antenna dish may include a front surface and a rear surface. The connecting arm has a first end and a second end, wherein the first end is coupled with the rear surface of the antenna dish. The pole may extend transversely with respect to the connecting arm and may include a channel extending from one end to the other end of the pole. The at least one clamp may each include a base with an opening that allows the pole to pass through.

The cover bracket may include a front cover to seal the second end of the connecting arm, and a first cover integral with the front cover that includes a first side and a second side. The first cover may support the pole over the connecting arm on the first side and engage with the connecting arm with the second side.

Some examples of the present invention may also provide a satellite antenna that comprises a connecting arm, a clamp for holding an electronic device and a pole having a profile that allows the pole to pass through the opening. The clamp may include a base with an opening. The pole may extend transversely with respect to the connecting arm and include a channel extending from one end to the other end of the pole, an upper surface over the channel to serve as a first track for the clamp to move along the pole, and a pair of flanges extending between the one end and the other end of the pole and spaced apart by a predetermined distance to define a second track for fastening elements.

Examples of the present invention may further provide a satellite antenna that comprises a connecting arm, a pole extending transversely with respect to the connecting arm, a clamp for holding an electronic device, and a cover bracket. The pole may include a channel extending from one end to the other end of the pole, and a pair of flanges opposed to each other extending between the one end and the other end of the pole. The clamp may include a base with an opening that allows the pole to pass through. The cover bracket may include a front cover including a pair of fins to butt against a pair of opposed inner walls of the connecting arm as the front cover seals an open end of the connecting arm, and a first cover integral with the front cover that includes at least one ridge on a first side thereof arranged to be fit into the channel through the flanges.

Other objects, advantages and novel features of the present invention will be drawn from the following detailed embodiments of the present invention with attached drawings, in which:

BRIEF DESCRIPTION OF THE SEVERAL VIEWS OF THE DRAWINGS

The foregoing summary as well as the following detailed description of the preferred examples of the present invention will be better understood when read in conjunction with the appended drawings. For the purposes of illustrating the invention, there are shown in the drawings examples which are presently preferred. It is understood, however, that the invention is not limited to the precise arrangements and instrumentalities shown. In the drawings.

DETAILED DESCRIPTION OF THE INVENTION

Reference will now be made in detail to the present examples of the invention illustrated in the accompanying drawings. Wherever possible, the same reference numbers will be used throughout the drawings to refer to the same or like portions. It should be noted that the drawings are made in simplified form and are not drawn to precise scale. In reference to the disclosure herein, for purposes of convenience and clarity only, directional terms, such as left, right, bottom, upper, lower, rear, and front, are used with respect to the accompanying drawings. Such directional terms used in conjunction with the following description of the drawings should not be construed to limit the scope of the invention in any manner not explicitly set forth in the appended claims.

Figure 1:
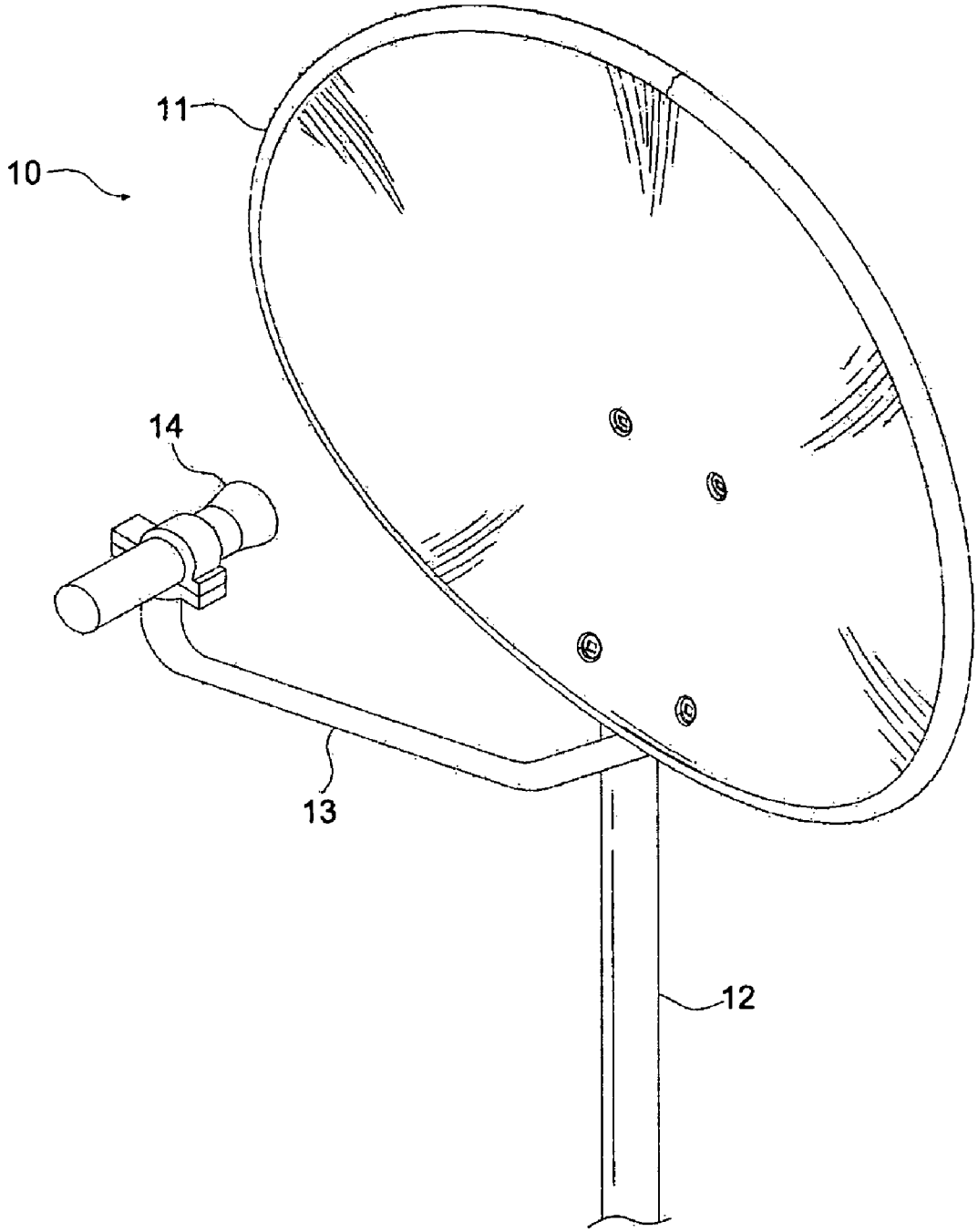
FIG. 1 (PRIOR ART)
FIG. 1 is a perspective view of a conventional satellite antenna.
Figure 2B:
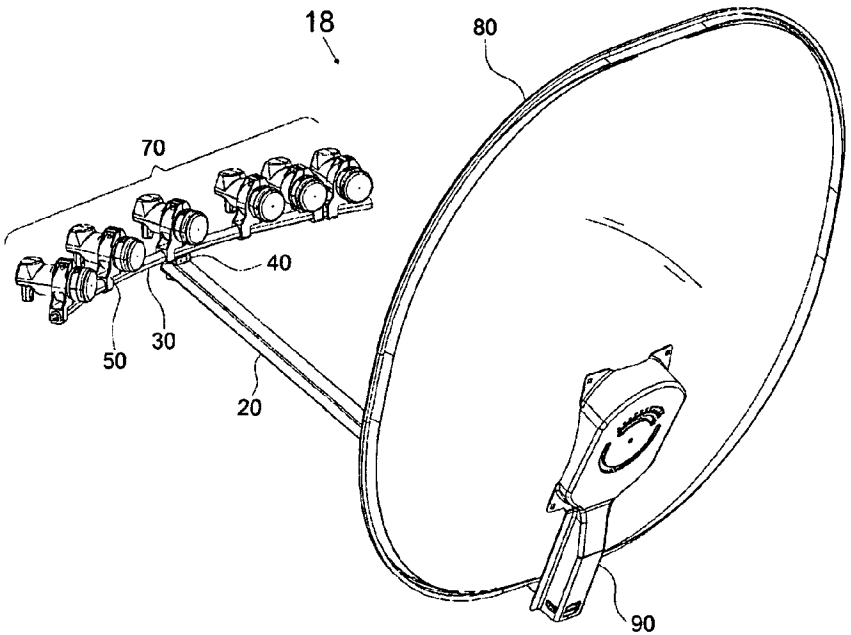
FIG. 2B is a left rear isometric view of the satellite antenna illustrated in FIG. 2A.
Figure 2A:
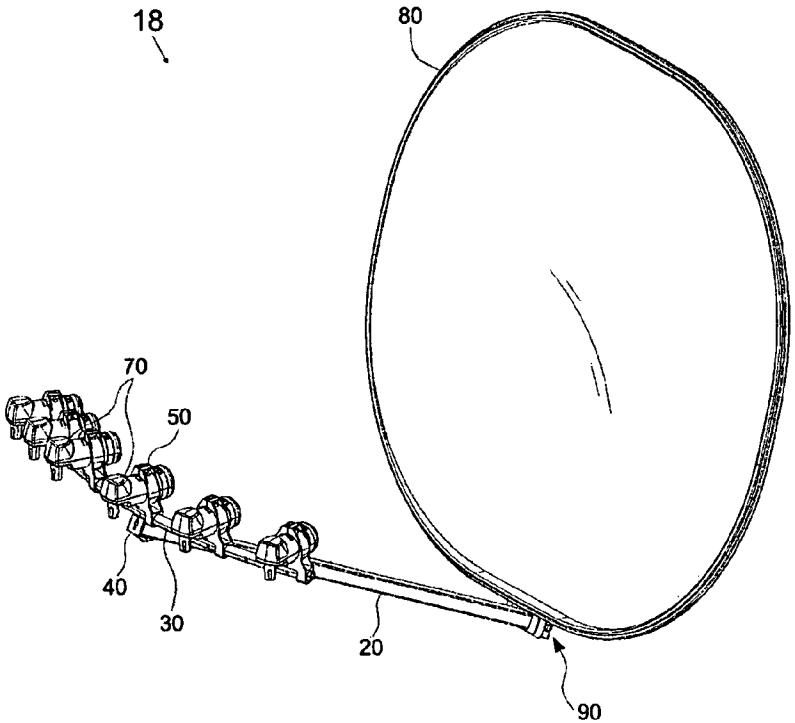
FIG. 2A is a left front isometric view of a satellite antenna in accordance with an example of the present invention.

FIG. 2A is a left front isometric view of a satellite antenna 18 in accordance with an example of the present invention. Referring to FIG. 2A, the satellite antenna 18 may include a connecting arm 20, an antenna dish 80, and a holder assembly that comprises a pole 30, a cover bracket 40 and at least one clamp 50. The connecting arm 20 may include a first end coupled to a support assembly 90 and a second end coupled to the pole 30 through the cover bracket 40. The holder assembly may facilitate the orientation of at least one electronic device 70 such as a low-noise amplifier (LNA) with a downconverter (collectively LNB) or an LNB with a feed horn (collectively LNBF). Skilled persons in the art will understand that the satellite antenna 18 may further include a mast (not shown) for supporting the antenna dish 80. Furthermore, the antenna dish 80 may have a parabolic dish surface to facilitate the collection of signals.

FIG. 2B is a left rear isometric view of the satellite antenna 18 illustrated in FIG. 2A. Referring to FIG. 2B, the pole 30 may be coupled to the second end of the connecting arm 20 through the cover bracket 40 and extend transversely with respect to the connecting arm 20. In the present example, the pole 30 may take the form of an arc shape, which may be curved outwardly away from the antenna dish 80. In other examples, however, the pole 30 may extend substantially orthogonal to the connecting arm 20. Each of the at least one LNBF 70 may be coupled to the pole 30 through one of the at least one clamp 50. The size of the pole 30 may depend on the size of the antenna dish 80 or the number of LNBF. In the present example, a number of six LNBFs 70 may be arranged to "perch" on the pole 30 and face toward the antenna dish 80.

Figure 2D:
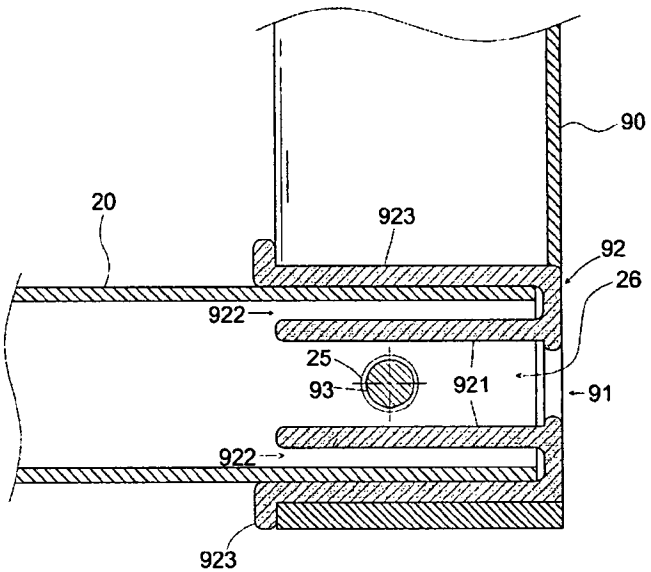
FIG. 2D is a cross-sectional view showing an assembled status of the connector illustrated in FIG. 2C.
Figure 2C:
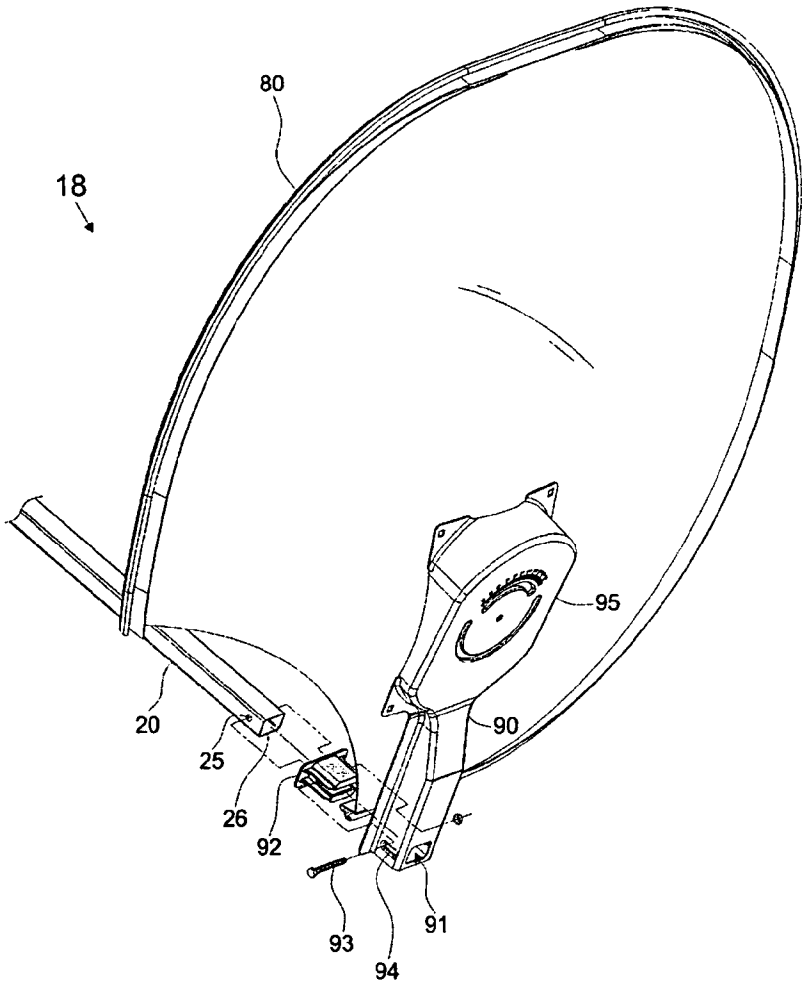
FIG. 2C is a perspective view showing a pre-assemble status of a connector of the satellite antenna illustrated in FIG. 2B.

FIG. 2C is a perspective view showing a pre-assemble status of a connector 92 of the satellite antenna 18 illustrated in FIG. 2B. Referring to FIG. 2C, the support assembly 90 may include a support bracket 95 attached to the rear surface of the antenna dish 80, and a channel 91 to receive the connector 92. In one example, the connector 92 may be made of a plastic material. The support assembly 90 may further include a slot 94, through which a fastening element 93 such as a bolt may extend to hold the connector 92 in place with a nut (not numbered). The connecting arm 20 may be coupled to the connector 92 at the first end 26, which is an open end. The connecting arm 20 has a hole 25 near the first end 26, which may facilitate the fastening element 93 to secure the connecting arm 20 and the connector 92 to the support assembly 90.

FIG. 2D is a cross-sectional view showing an assembled status of the connector 92 illustrated in FIG. 2C. Referring to FIG. 2D, the connector 92 may include a pair of ribs 921 extending in parallel to each other. Chambers 922 may be defined between the ribs 921 and their respective outer walls 923 of the connector 92. With the chambers 922, the first end 26 of the connecting arm 20 may fit snugly into the connector 92.

Figure 3:
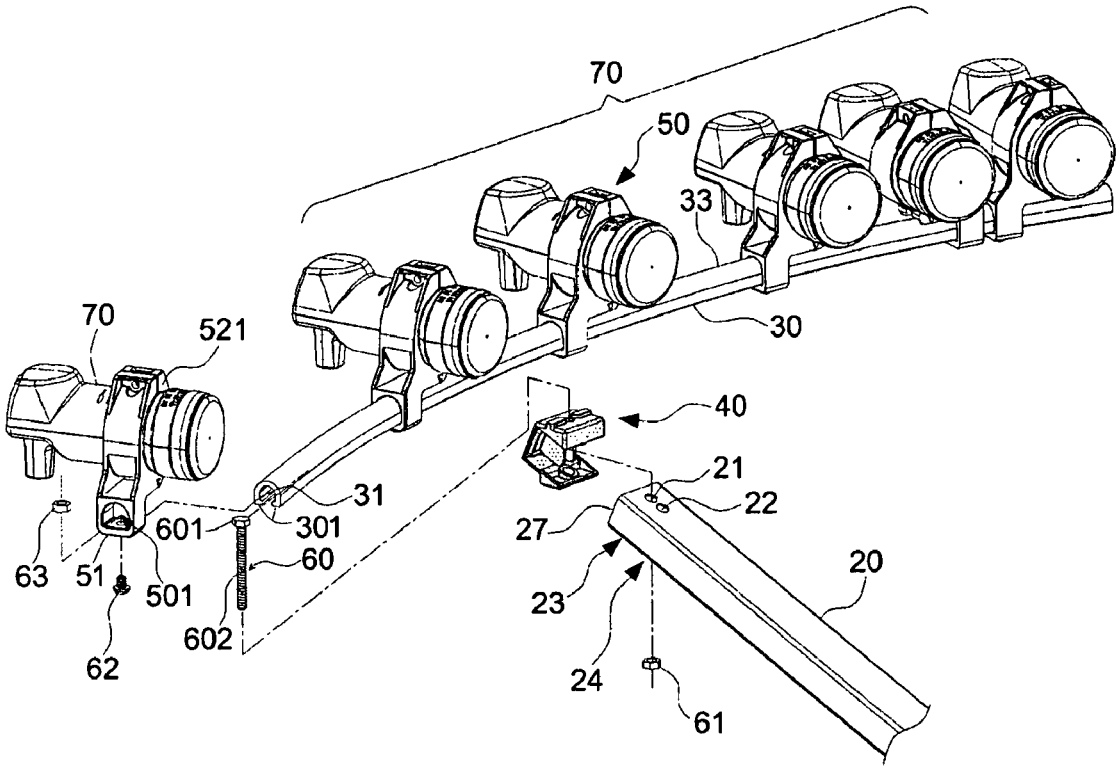
FIG. 3 is a partially exploded perspective view of a holder assembly in accordance with an example of the present invention.

FIG. 3 is a partially exploded perspective view of the holder assembly in accordance with an example of the present invention. Referring to FIG. 3, the holder assembly, as previously discussed, may include the pole 30, the cover bracket 40 and the at least one clamp 50. The pole 30 may include an inverted U-shaped channel 31 and an arc-shaped upper surface 33. The channel 31 may extend from one end to the other end of the pole 30. Each of the at least one clamp 50 may include a base 51 with an opening 501 sized to fit the profile of the channel 31. Specifically, the opening 501 may have an inverted U-shaped profile to allow the pole 30 to pass or tunnel through and then the clamp 50 to slide on the pole 30. Skilled persons in the art will understand that the upper surface 33 may not be limited to an arc-shaped profile and the opening 501 may be formed in other shape to fit a desired profile of the upper surface 33. Fastening elements such as a bolt 62 and a nut 63 may be used to secure the clamp 50 to the pole 30 at a desired position. Each of the at least one clamp 50 may also include a releasable member 521 to release or loosen the respective LNBF 70 from a clamped status, which will be discussed by reference to FIGS. 5A and 5B.

The cover bracket 40 on one hand may serve as a cover to seal the second end 27, which is an open end, of the connecting arm 20 so as to prevent the connecting arm 20 from moisture attack. A first pair of holes 21 and 22 and a second pair of holes 23 and 24 (also shown in FIG. 4C) may be provided near the second end 27 so as to facilitate the coupling between the cover bracket 40 and the connecting arm 20, which will be discussed by reference to FIGS. 4A to 4C. Furthermore, fastening elements such as a bolt 60 and a nut 61 may be used to secure the connecting arm 20 via the cover bracket 40 to the pole 30 at a desired position. The pole 30 may further include a pair of flanges 301 extending between both ends of the pole 30 in substantially the same direction as the pole 30. The flanges may be opposed to each other and spaced apart by a suitable distance. The distance may be greater than the diameter of the threaded shaft 602 of the bolt 60 and smaller than the diameter of the head 601 of the bolt 60. Thus, while the upper surface 33 of the pole 30 provides a first track for the at least one clamp 50 to move along, the flanges 301 of the pole 30 with the distance defined in the channel 31 may provide a second track for fastening elements. As a result, in fastening the cover bracket 40, the pole 30 and the connecting arm 20, the bolt 60 may be put into the channel 31 in a radial direction with the head 601 retained within the channel 31 and the threaded shaft 602 extending via the cover bracket 40 into the first hole 21 and the second hole 24 to combine with the nut 61.

The cover bracket 40 on the other hand may serve as a bracket to uphold the pole 30, which will be discussed below by reference to FIGS. 4A to 4C.

Figure 4B:
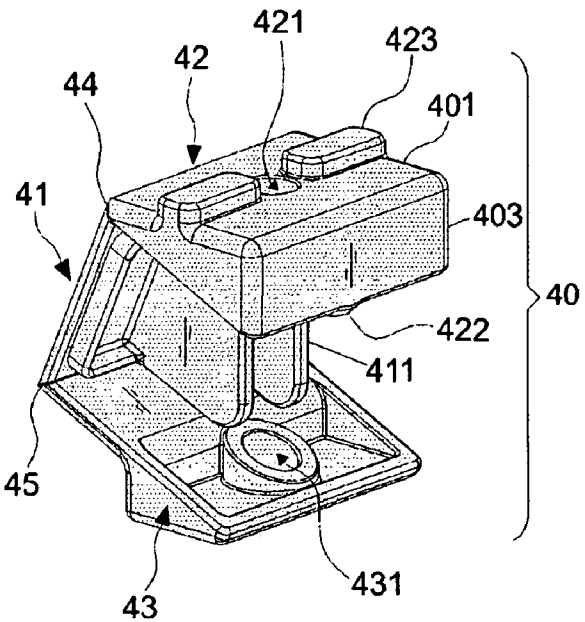
FIG. 4B is a perspective view showing a folded status of the cover bracket illustrated in FIG. 4A.
Figure 4A:
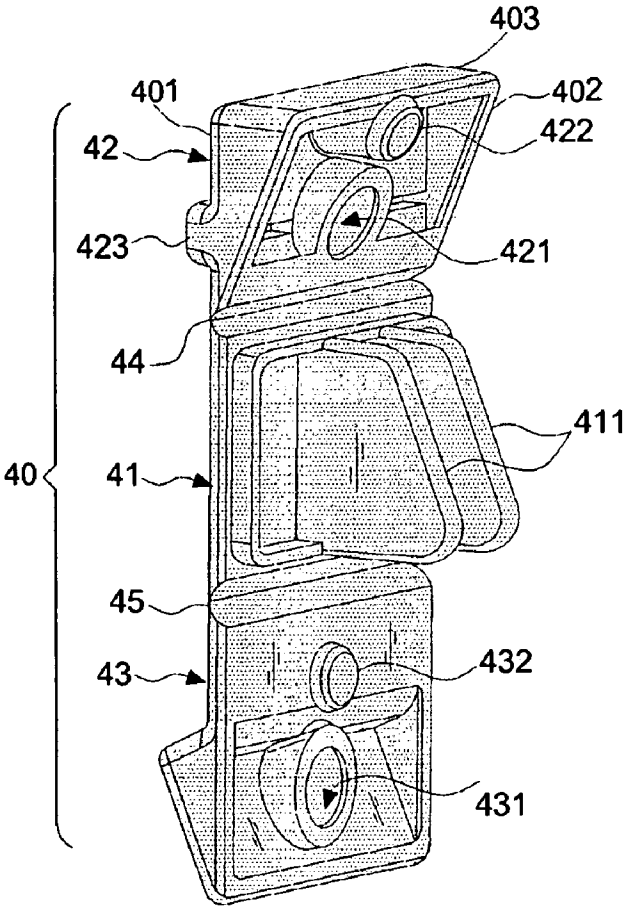
FIG. 4A is a perspective view showing an unfolded status of a cover bracket in accordance with an example of the present invention.

FIG. 4A is a perspective view showing an unfolded status of the cover bracket 40 in accordance with an example of the present invention. Referring to FIG. 4A, the cover bracket 40 may include a front cover 41, a first or upper cover 42 integral with the front cover 41, and a second or lower cover 43 integral with the front cover 41 and separated from the first cover 42 by the front cover 41. In one example, the cover bracket 40 may be made of plastic, polyvinyl chlorate (PVC) or other suitable material having sufficient strength and rigidity to perform its intended functions, and may be fabricated by, for example, plastic extrusion. The front cover 41 may include a pair of parallel fins 411 at its inner surface. The first cover 42 has a first through hole 421 and may include at least one ridge 423 on a first or outer side 401 and a first button 422 at a second or inner side 402. The second cover 43 has a second through hole 431 and may include a second button 432 at its inner side. Furthermore, the front cover 41 may interface with the first cover 42 and the second cover 43 with a first foldable groove 44 and a second foldable groove 45, respectively. In one example, each of the first and second foldable grooves 44 and 45 may include a V-shaped profile.

FIG. 4B is a perspective view showing a folded status of the cover bracket 40 illustrated in FIG. 4A. Referring to FIG. 4B, the pair of parallel fins 411 may be separated away from each other to define a space therebetween, which allows the first and second through holes 421 and 431 to align with each other when the first and second covers 42 and 43 are folded toward the fins 411. The at least one ridge 423 may be arranged in tangential alignment with the center of the pole 30 and, when coupled with the pole 30, may be fit or snapped into the channel 31 and bear against the flanges 301 of the pole 30. In the present example, the at least one ridge 423 includes two ridge members spaced apart by the first through hole 421. In the folded status as illustrated, the first and second foldable grooves 44 and 45 may be held at a folded state.

Figure 4D:
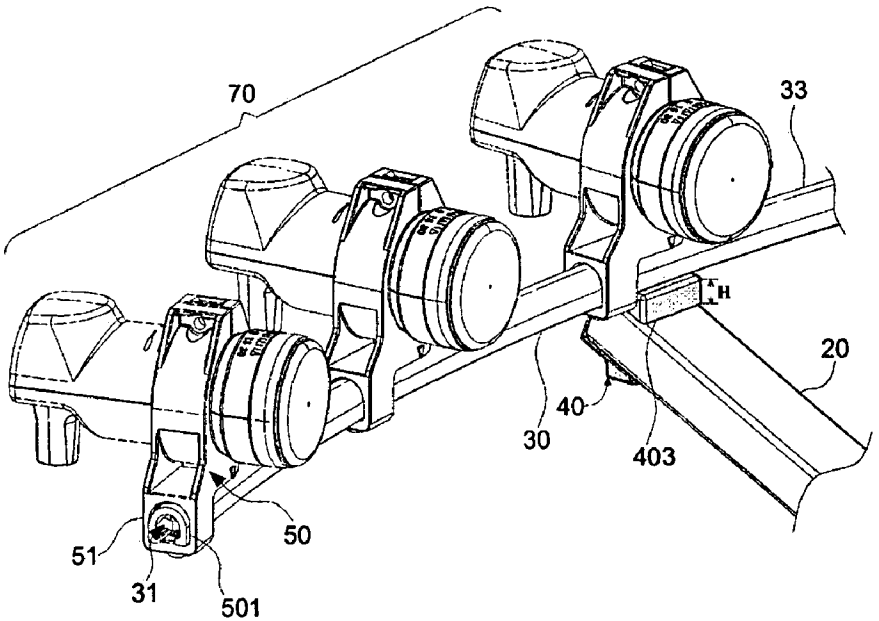
FIG. 4D is a perspective view showing a function of the cover bracket illustrated in FIG. 4A.
Figure 4C:
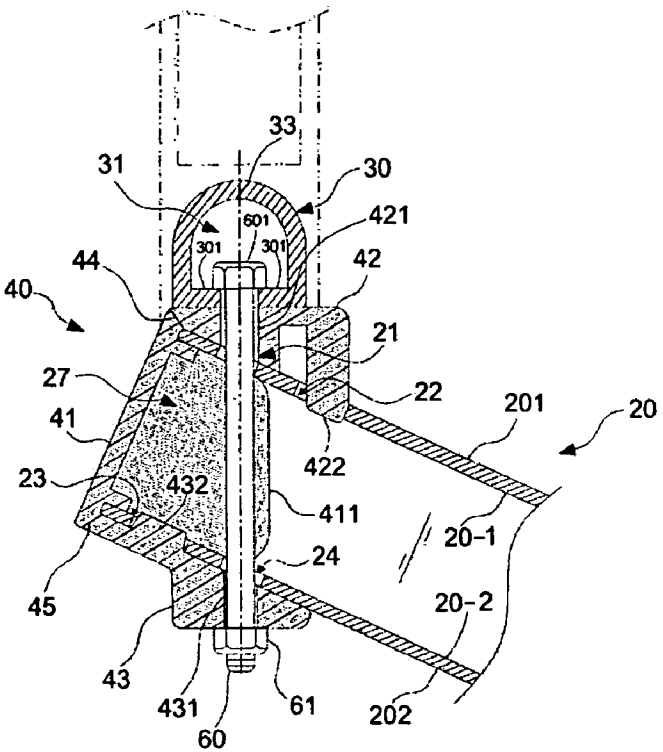
FIG. 4C is a cross-sectional view showing a coupling status of the cover bracket illustrated in FIG. 4A.

FIG. 4C is a cross-sectional view showing a coupling status of the cover bracket 40 illustrated in FIG. 4A. To combine the pole 30, cover bracket 40 and connecting arm 20 together, referring to FIG. 4C, the front cover 41 may be applied to enclose the second end 27 with the parallel fins 411 shoving along and butting against the opposed inner walls 20-1 and 20-2 of the connecting arm 20. Furthermore, the first cover 42 may be bent at the first foldable groove 44 to engage with the connecting arm 20 at a first outer wall 201 thereof by buttoning the first button 422 with the first button hole 22. The first cover 42 may thus support the pole 30 over the connecting arm 20 on the first side 401 and engage with the connecting arm 20 with the second side 402. Similarly, the second cover 43 may be bent at the second foldable groove 45 to engage with the connecting arm 20 at a second outer wall 202 thereof by buttoning the second button 432 with the second button hole 23. Consequently, the front cover 41 may enclose the second end 27 firmly as the parallel fins 411 butt against the inner walls 20-1 and 20-2 while the first and second buttons 422 and 432 button up the outer walls 201 and 202, respectively.

Next, the fastening element 60 may be applied to engage the pole 30 with the combined cover bracket 40 and connecting arm 20. The fastening element 60 may be placed with its head 601 retained within the channel 31 by the flanges 301 and the threaded shaft 602 extending through the cover bracket 40 and the connecting arm 20 via the first through hole 421, first hole 21, the space defined between the parallel fins 411, second hole 24 and second through hole 431 to combine with the nut 61.

FIG. 4D is a perspective view showing a function of the cover bracket 40 illustrated in FIG. 4A. In addition to sealing the connecting arm 20 and upholding the pole 30, referring to FIG. 4D, the cover bracket 40 may function to support the pole 30 at a predetermined angle. Specifically, the first cover 42 may include a third or front side 403 facing toward the antenna dish 80 as the cover bracket 40 is coupled to the connecting arm 20. The first cover 42 may thus have a profile tapered from the third side 403 to the first foldable groove 44. The third side 401 has a predetermined height "H" so that the pole 30 and in turn the at least one LNBF 70 may be held at a desired angle with respect to the connecting arm 20 in order to collect signals from the antenna dish 80.

Figure 5A:
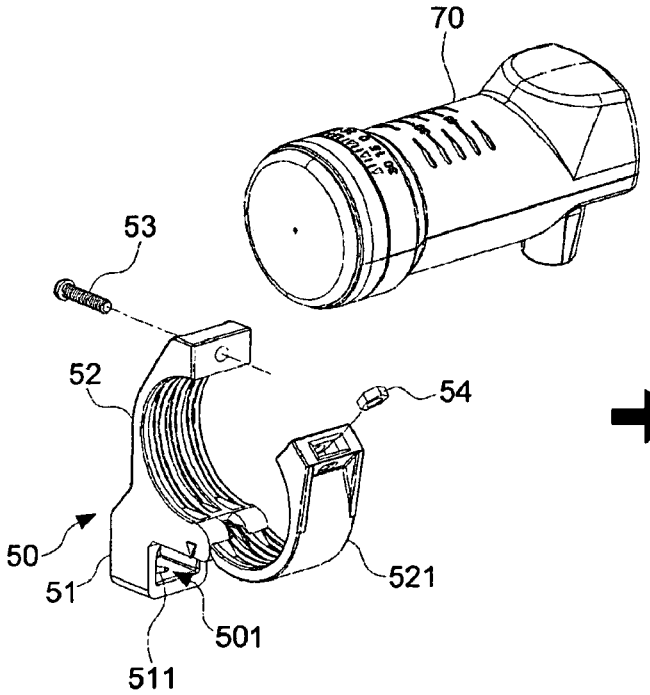
FIG. 5A is a perspective view showing a released status of a clamp in accordance with an example of the present invention.
Figure 5B:
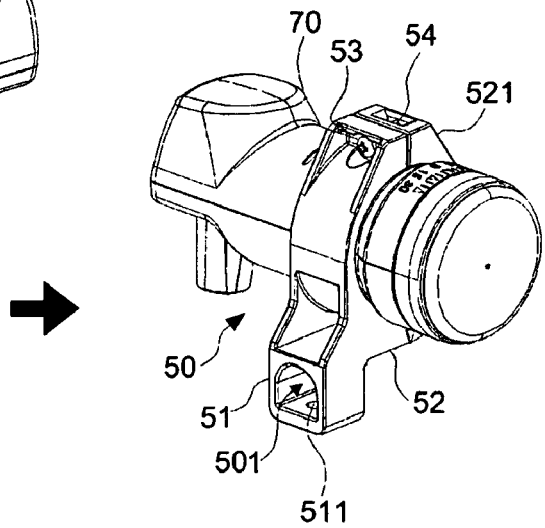
FIG. 5B is a perspective view showing a clamped status of the clamp illustrated in FIG. 5A.

FIG. 5A is a perspective view showing a released status of the clamp 50 in accordance with an example of the present invention, and FIG. 5B is a perspective view showing a clamped status of the clamp 50 illustrated in FIG. 5A. Referring to FIG. 5A, in addition to the base 51 with the opening 501, the clamp 50 may include a stationary member 52 immobile with respect to the base 51, and a releasable member 521 mobile with respect to the base 51. The base 51 has a hole 511 at its bottom surface (not numbered). The stationary member 52 and the releasable member 521 may be sized to fit the LNBF 70. Fastening elements such as a bolt 53 and a nut 54 may be used to fasten the stationary member 52 and the releasable member 521. Referring to FIG. 5B, the stationary member 52 and the releasable member 521 may clamp around the neck of the LNBF 70 so as to hold the LNBF 70 in place.

Figure 5D:
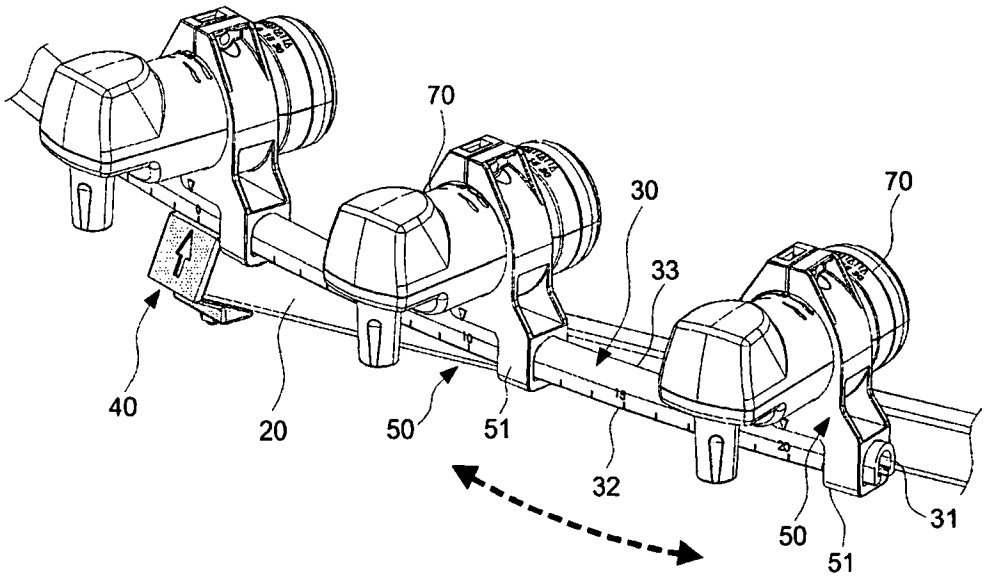
FIG. 5D is a perspective view showing a function of the clamp illustrated in FIG. 5A.
Figure 5C:
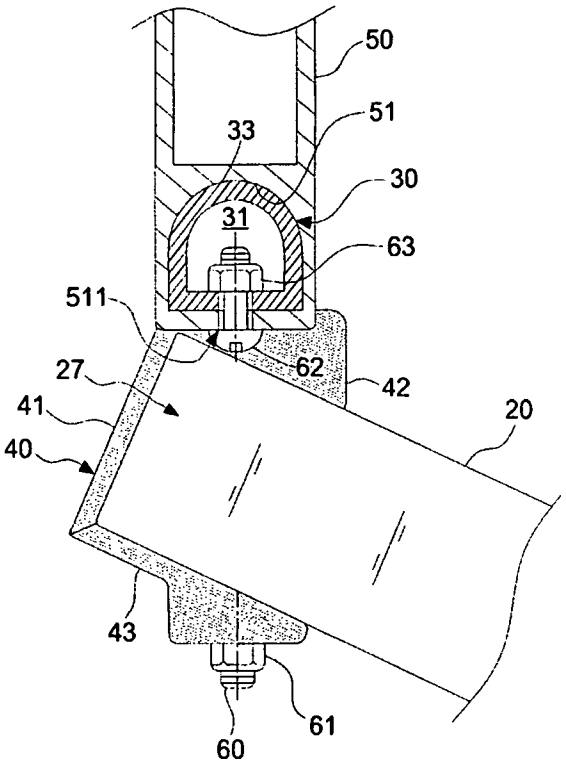
FIG. 5C is a cross-sectional view showing a coupling status of the clamp illustrated in FIG. 5A.

FIG. 5C is a cross-sectional view showing a coupling status of the clamp 50 illustrated in FIG. 5A. Referring to FIG. 5C, the clamp 50 may be engaged to the pole 30 by passing the pole 30 through the opening 501, which may conform to the channel 31 in profile, and then combining the pole 30 and the clamp 50 with the bolt 62 and the nut 63 through the bottom hole 511 at a desired position in the channel 31.

FIG. 5D is a perspective view showing a function of the clamp 50 illustrated in FIG. 5A. Referring to FIG. 5D, before fastened to the pole 30, the clamp 50, as shown by a dashed arrow, may be allowed to slide on the surface 33 until a desired position is reached. The pole 30 may further include an azimuth indicator 32 with azimuth readings circumferentially formed around the pole 30. The azimuth readings, which may be etched, printed, inscribed, embossed or otherwise permanently formed on the pole 30, may facilitate the orientation of the LNBF 70.

In describing representative examples of the present invention, the specification may have presented the method and/or process of operating the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

It will be appreciated by those skilled in the art that changes could be made to the examples described above without departing from the broad inventive concept thereof. It is understood, therefore, that this invention is not limited to the particular examples disclosed, but it is intended to cover modifications within the spirit and scope of the present invention as defined by the appended claims.

We claim:

1. A satellite antenna comprising:

an antenna dish including a front surface and a rear surface;

a connecting arm having a first end and a second end, the first end coupled with the rear surface of the antenna dish;

a pole extending transversely with respect to the connecting arm and including a channel extending from one end to the other end of the pole;

at least one clamp each including a base with an opening that allows the pole to pass through; and a cover bracket including:

a front cover to seal the second end of the connecting arm; and a first cover integral with the front cover and including a first side and a second side, the first cover supporting the pole over the connecting arm on the first side and engaging with the connecting arm with the second side.

2. The satellite antenna of claim 1, wherein the pole includes a pair of flanges extending from the one end to the other end of the pole and spaced apart from one another by a predetermined distance to define a track for fastening elements.

3. The satellite antenna of claim 1, wherein each of the channel and the opening has an inverted U-shaped profile.

4. The satellite antenna of claim 1, wherein the pole has an arc shape curved away from the front surface of the antenna dish.

5. The satellite antenna of claim 1, wherein each of the at least one clamp further includes a stationary member immobile with respect to the base and a releasable member mobile with respect to the base.

6. The satellite antenna of claim 1, wherein the first cover includes a third side of a predetermined height facing toward the front surface of the antenna dish.

7. The satellite antenna of claim 2, wherein the first cover includes at least one ridge on the first side arranged to be fit into the channel through the flanges.

8. The satellite antenna of claim 1, wherein the cover bracket further includes a second cover integral with the front cover and separated from the first cover by the front cover, and wherein the front cover is connected to the first cover and the second cover via a first foldable groove and a second foldable groove, respectively.

9. The satellite antenna of claim 8, wherein the front cover includes a pair of fins to butt against a pair of opposed inner walls of the connecting arm as the front cover seals the second end.

10. The satellite antenna of claim 8, wherein the first cover has a first through hole and the second cover has a second through hole, and wherein the first through hole and the second through hole align with each other through a space defined between the pair of fins as the first cover and the second cover are engaged with the connecting arm.

11. The satellite antenna of claim 8, wherein the first cover includes a first button to secure the first cover to the connecting arm.

12. The satellite antenna of claim 8, wherein the second cover includes a second button to secure the second cover to the connecting arm.

13. A satellite antenna comprising:

an antenna dish;

a connecting arm for connecting to the antenna dish;

a clamp for holding an electronic device, the clamp including a base with an opening; and a pole having a profile that allows the pole to pass through the opening, the pole extending transversely with respect to the connecting arm and including:

a channel extending from one end to the other end of the pole;

an upper surface over the channel to serve as a first track for the clamp to move along the pole; and a pair of flanges extending between the one end and the other end of the pole and spaced apart by a predetermined distance to define a second track for fastening elements.

14. The satellite antenna of claim 13, wherein each of the channel and the opening has an inverted U-shaped profile.

15. The satellite antenna of claim 13 further comprising a cover bracket that includes:

a front cover to seal an open end of the connecting arm; and a first cover integral with the front cover and including a first side and a second side, the first cover supporting the pole over the connecting arm on the first side and engaging with the connecting arm with the second side.

16. The satellite antenna of claim 15, wherein the first cover includes at least one ridge on the first side arranged to be fit into the channel through the flanges.

17. The satellite antenna of claim 15, wherein the front cover includes a pair of fins to butt against a pair of opposed inner walls of the connecting arm as the front cover seals the open end of the connecting arm.

18. A satellite antenna comprising:

an antenna dish;

a connecting arm for connecting to the antenna dish;

a pole extending transversely with respect to the connecting arm and including: a channel extending from one end to the other end of the pole; and a pair of flanges opposed to each other extending between the one end and the other end of the pole;

a clamp for holding an electronic device, the clamp including a base with an opening that allows the pole to pass through; and a cover bracket including:

a front cover including a pair of fins to butt against a pair of opposed inner walls of the connecting arm as the front cover seals an open end of the connecting arm; and a first cover integral with the front cover and including at least one ridge on a first side thereof arranged to be fit into the channel through the flanges.

19. The satellite antenna of claim 18, wherein the cover bracket further includes a second cover integral with the front cover and separated from the first cover by the front cover, and wherein the front cover is connected to the first cover and the second cover via a first foldable groove and a second foldable groove, respectively.

20. The satellite antenna of claim 19, wherein the first cover has a first through hole and the second cover has a second through hole, and wherein the first through hole and the second through hole align with each other through a space defined between the pair of fins as the first cover and the second cover are engaged with the connecting arm.

* * * * *